US005363452A

United States Patent [19]

Anderson

[11] Patent Number: 5,363,452

[45] Date of Patent: Nov. 8, 1994

[54] MICROPHONE FOR USE IN A VIBRATING ENVIRONMENT

[75] Inventor: C. Roger Anderson, Wilmette, Ill.

[73] Assignee: Shure Brothers, Inc., Evanston, Ill.

[21] Appl. No.: 884,805

[22] Filed: May 19, 1992

[51] Int. Cl.[5] ..... H04R 25/00

[52] U.S. Cl. ..... 381/168; 381/173; 381/190; 381/92

[58] Field of Search ..... 381/168, 173, 174, 190, 381/71, 95, 92, 94; 340/384.6; 330/174

[56] References Cited

U.S. PATENT DOCUMENTS

| | | | |
|---|---|---|---|
| 2,967,957 | 1/1961 | Massa | 310/9.4 |
| 3,435,260 | 3/1969 | Seidel | 310/8.3 |
| 3,761,956 | 9/1973 | Takahashi et al. | 381/173 |
| 4,442,323 | 4/1984 | Yoshida et al. | 381/95 |
| 4,494,032 | 1/1985 | Martin | 381/173 |
| 4,602,245 | 7/1986 | Yang et al. | 381/190 |
| 4,700,177 | 10/1987 | Nakashima et al. | 181/163 |
| 4,965,777 | 10/1990 | Timossi et al. | 367/140 |
| 5,022,082 | 6/1991 | Eriksson et al. | 381/71 |

FOREIGN PATENT DOCUMENTS

| | | | |
|---|---|---|---|
| 0171197 | 10/1983 | Japan | 381/193 |
| 62-6596 | 1/1987 | Japan | 381/190 |
| 0120600 | 5/1988 | Japan | 381/190 |
| 0160200 | 1/1989 | Japan | 381/173 |
| 1592957 | 9/1990 | U.S.S.R. | 381/173 |

*Primary Examiner*—Curtis Kuntz
*Assistant Examiner*—Huyen D. Le
*Attorney, Agent, or Firm*—Allegretti & Witcoff, Ltd.

[57] ABSTRACT

A microphone for use in a harsh environment of intense vibration and sound pressure. A microphone transducer and an acceleration transducer are located adjacent each other inside of a housing. The microphone transducer substantially blocks much of the acoustic signal from reaching the acceleration transducer. Accordingly, the acceleration transducer provides a signal substantially related only to the movement of the microphone, while the microphone transducer provides a signal related to both the movement of the microphone and the acoustic signal applied to it. The acceleration signal may then be removed from the microphone signal, providing a electrical signal substantially representative only of the acoustic signal.

22 Claims, 3 Drawing Sheets

MICROPHONE FOR USE IN A VIBRATING ENVIRONMENT

BACKGROUND OF THE INVENTION

The present invention relates generally to microphones that convert acoustic signals to electrical signals and, more particularly, to a microphone that may be subjected to both substantial vibration and sound pressure. Such an environment may exist, for example, in an automotive vehicle active noise cancellation system.

In such a system, a microphone may be attached to an exhaust pipe, or other component, of an automobile. Signals from the microphone may then be interconnected to a synthesizer, or other computer, to analyze the acoustic signals received by the microphone. Thereafter, the synthesizer responsively provides cancelling, counter-phase acoustic signals to, in effect, "cancel out" the noise of the automobile engine.

Such noise cancellation systems are often used to "muffle" an engine's noise, while minimizing the back pressure on the engine that may be induced with other types of noise mufflers. As a result, active noise cancellation systems result in greater power and fuel economy than if more conventional, passive mufflers are used.

The microphone in the cancellation system may be used to measure what acoustic signals are being generated by the car engine at a particular time (with the engine at a particular power level). This enables the synthesizer to cause the correct acoustic signal to be produced.

The microphone may also be used to sense how well the cancellation system has achieved its objective of providing counter-phase, nullifying noise. Accordingly, the microphone may be used as a part of a feedback system to tune the phase of the cancellation signal produced by the synthesizer.

The environment in which such a noise cancellation system operates is particularly harsh for a microphone. The microphone is subjected to substantial vibration as the vehicle travels. A transducer within a microphone (which converts acoustic signals into electrical signals) may be affected not only by acoustic signals, but the vibration as well. As a result, the microphone may produce an electrical signal which, rather than being truly representative of the sound received by the microphone, instead represents a combination of both the sound and the vibration that the microphone happens to be experiencing.

Such a microphone in an automotive active nose cancellation system may be subjected to intense heat from the vehicle's exhaust system. Such microphones may be required to operate at elevated temperatures of up to 3500° F. or more.

Moreover, such microphones must operate with the high sound levels of automotive engines. The sound pressures generated by an engine may be as high as 175 db SPL or more.

Nonetheless, such microphones should be relatively small in size and inexpensive to construct, so that they may be more readily attached to mass-produced automotive vehicles. The microphones should also operate at frequencies below 500 hertz, since such lower frequency sounds are generally the most difficult for conventional, passive muffler systems to control.

Microphones are also used in other types of harsh environments, such as, for example, as part of a knock-sensor assembly on an automobile engine. Such microphones are positioned in the engine compartment to sense the operation of the engine pistons. Of course, such microphones are subjected to extensive vibration, high sound pressure, and elevated temperatures, and must still be small and inexpensive.

Many conventional microphones are poorly suited for use in an environment of high vibration, sound pressure, and temperature. In response to being vibrated, some microphones may add spurious signals to the electrical signals representing the sound. Others cannot withstand intense sound pressure or high temperatures without malfunctioning. Others have substantially reduced sensitivity to both noise as well as vibration, reducing the effectiveness of the microphones.

One technique of reducing the vibration sensitivity of a microphone is to keep the mass of the transducer small. However, in a severe environment, this technique also reduces the physical strength of the transducer. Thus, low transducer-mass microphones may be inappropriate for use in an environment of intense vibrations, high sound pressures, and elevated temperatures.

SUMMARY OF THE INVENTION

In a principal aspect, the present invention is a microphone for use in an environment of substantial vibration and high sound pressure. The microphone includes a housing defining a chamber within it. Within the chamber is a microphone transducer that receives acoustic signals. Further back in the chamber is an acceleration transducer.

The microphone transducer provides an electrical signal in response to sensing both acoustic signals and vibration. The acceleration transducer provides an electrical signal substantially more representative of vibration than sound. Accordingly, the signals from the microphone and acceleration transducers represent, respectively, (1) sound and vibration and (2) substantially only vibration. In one embodiment, the signals from the transducers may be selectively combined to produce a signal substantially representative of only the sound.

In yet another embodiment of the present invention, the microphone includes a transducer bonded to a diaphragm and a pair of positioning assemblies, such as knife-edged cylinders. The edges of the cylinders hold the diaphragm and transducer in place. Because the transducer may flex on both sides of the cylinder walls in response to being vibrated, the electrical signal produced by the transducer substantially represents only sound.

Thus, an object of the present invention is an improved microphone for use in an environment of substantial vibration. A further object is a microphone that more reliably withstands intense vibrations and high sound pressures. Still another object is a microphone that provides a signal that is more truly representative of the acoustic signal (rather than both the acoustic signal and spurious vibrations applied to the microphone).

Still a further object is a microphone that may be subjected to elevated temperatures as well as intense vibration and loud sound pressures and still provide a more accurate electrical representation of a wide range of acoustic signals applied to the microphone. Still another object is a improved microphone for harsh conditions that is less expensive to manufacture, while still being smaller and weighing less. These and other objects, features, and advantages of the present invention are discussed or apparent in the following detailed description.

BRIEF DESCRIPTION OF THE DRAWINGS

Preferred embodiments of the present invention are described herein with reference to the drawings wherein.

DETAILED DESCRIPTION OF THE PREFERRED EMBODIMENTS

Figure 1:
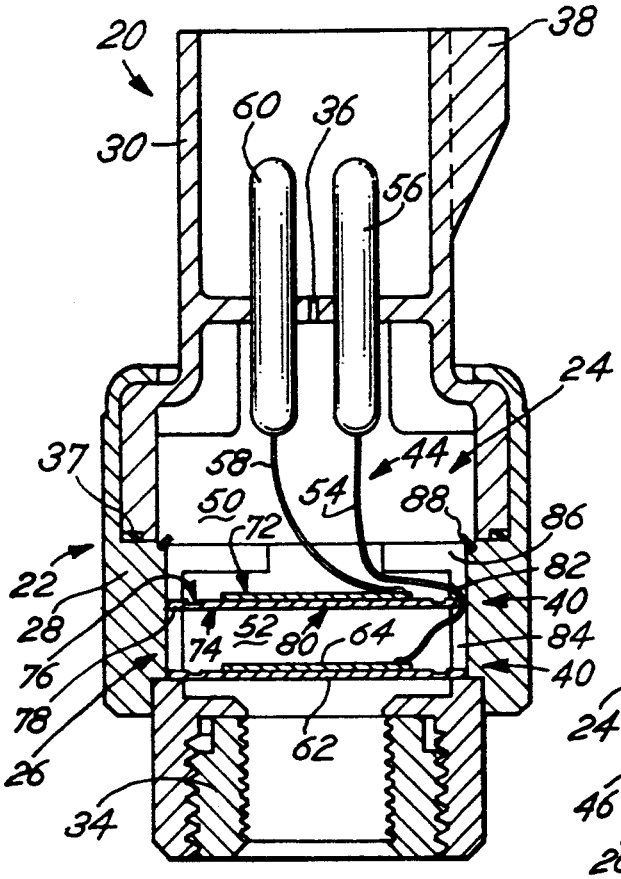
FIG. 1 is a side, cross-sectional view of the present invention.
Figure 2:
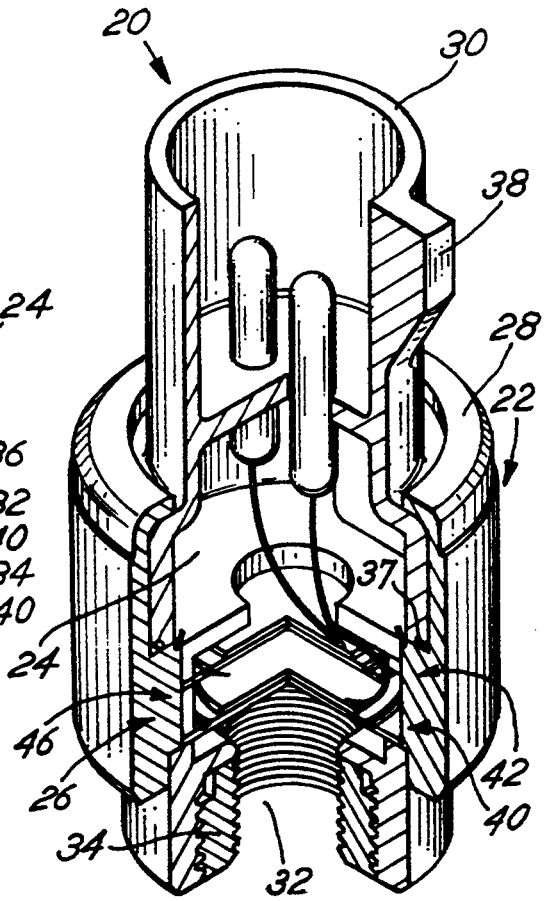
FIG. 2 is an isometric view of the invention shown in FIG. 2, with a partial cut-away showing the interior of the housing.
Figure 3:
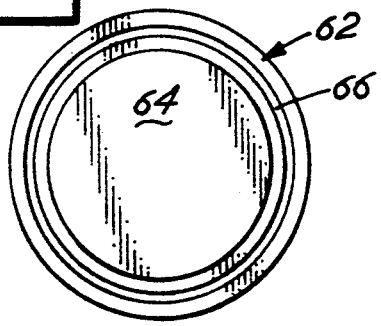
FIG. 3 is a top plan view of the diaphragm and transducer used in the invention shown in FIG. 1.
Figure 4:
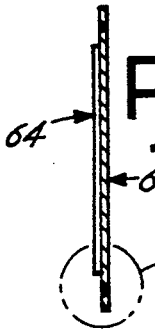
FIG. 4 is a side view of the diaphragm and transducer shown in FIG. 3.
Figure 5:
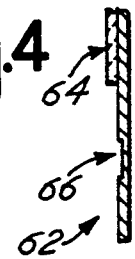
FIG. 5 is an enlarged, partial side view of the diaphragm and transducer shown in FIG. 4.

Referring to FIGS. 1–6, a first preferred embodiment of the present invention is shown as a microphone 20. As shown in FIGS. 1 and 2, the microphone 20 includes a housing 22, internal chamber 24, and transducer assembly 26.

The housing 22 is comprised of both a stainless steel shell 28 and a molded plastic shell 30 which cooperatively define the chamber 24. Both shells 28, 30 are capable of withstanding temperatures in excess of 300° F. The steel shell 28 defines a threaded input port 32 through which acoustic signals may travel into the chamber 24. The steel shell 28 further includes a insulator bushing 34 along the threaded port 32 so as to electrically isolate any male connector (not shown) that may be threaded into the port 32 from the rest of the housing 22.

The chamber 24 is open to the input port 32 and substantially closed on all other sides. The housing 22 may also include, however, a small vent hole 36 to allow air within the chamber 24 to vent out of the chamber 24 should the housing 22 be exposed to elevated temperatures. The vent hole 36 has a small diameter, so as to minimize the risk of debris or water entering the chamber 24. Thus, the housing 22 defines a substantially closed shell about the port 32 and, because the vent hole 36 is small, substantially blocks moisture or particulate from entering the chamber 24.

An 0-ring 37 is positioned between the steel and plastic shells 28, 30 to further prevent moisture and other contaminants from entering the chamber 24. The steel shell 28 is crimped around the plastic shell 30 to hold it in position.

The molded plastic shell 30 includes a keying fin 38. As a result, the plastic shell 30 may only be inserted into another electrical connector (not shown) having outside dimensions that are consistent with the keying fin 38. The entire housing 22, from the input port 32 to the end of the keying fin 38, is only approximately 2.2 inches.

The transducer assembly 26 includes a microphone transducer assembly 40, acceleration transducer assembly 42, and lead assembly 44. In the preferred embodiment shown in FIGS. 1–6, the transducer assembly 26 further includes a clamp assembly 46 and a signal processor 48.

The microphone transducer assembly 40 is substantially adjacent the input port 32 and lies between the input port 32 and the acceleration transducer assembly 42. The acceleration transducer assembly 42 may be considered as defining a sub-chamber, or air chamber 50, within the housing 22. The air chamber 50 is bounded by the housing 22 and the acceleration transducer assembly 42.

The microphone transducer assembly 40 tends to block the passage of soundwaves from further entering the chamber 24 or from reaching the acceleration transducer assembly 42. The microphone transducer assembly 40 and acceleration transducer assembly 42 thus define a buffer space 52 between them.

The lead assembly 44 includes a microphone wire 54, microphone terminal plug 56, acceleration wire 58, and acceleration terminal plug 60. The microphone and acceleration transducer assemblies 40, 42 are substantially similar in construction. Thus, only the microphone transducer assembly 40 is described herein for purposes of illustration.

As shown in FIGS. 1–4, the microphone transducer assembly 40 includes a circular, stainless steel diaphragm 62, approximately 0.007 inch thick, and a ceramic transducer 64, approximately 0.010 inch thick, bonded to the middle of the stainless steel diaphragm 62.

The diaphragm 62 is approximately 0.787 inch in diameter and includes a groove along the outer perimeter, approximately 0.043 inch from the outer edge of the diaphragm 62. The groove 66 is approximately 0.02 inch wide and extends into the diaphragm 62 approximately one-half the thickness of the diaphragm 62 (or approximately 0.0035 inch). A groove depth of as little as one-quarter the thickness of the diaphragm 62, or as great as three-quarters of the thickness of the diaphragm 62, may also be of use with the present invention. The purpose of the groove 66 is to provide a uniform flexibility adjacent to the mounting surface of diaphragm 62. Otherwise, the stiffness of the diaphragm is dependent upon the clamping force of the mounting means.

The groove 66 thus divides the diaphragm 62 into an inner flexing circle 68 and an outer ring 70. The groove 66 may be cut into the diaphragm 62 with a lathe or photo-etched onto the diaphragm 62.

The microphone wire 54 is bonded onto the ceramic transducer 64. The wire 54 interconnects the transducer 64 with the microphone terminal plug 56. The terminal plug 52 is fixedly held by the housing 22 and extends from the chamber 24 outside of the housing 22.

Since the acceleration transducer assembly 42 is similar in construction to the microphone transducer assembly 40, it includes an acceleration ceramic transducer 72 and acceleration diaphragm 74 having a groove 76 therein. The groove 76 defines an acceleration outer ring 78 and inner flexing circle 80.

Notably, the microphone wire 54 passes around the acceleration transducer assembly 42. The passage for the wire 54 around the acceleration transducer assembly 42 provides a small vent hole 82 for air to pass from the buffer space 52 to the sub-chamber 50. The vent hole 82 also provides communication between the two sides of the acceleration transducer 42, thereby greatly reducing the acoustic sensitivity for any sound present in sub-chamber 52. In the microphone 20, however, the microphone transducer assembly 40 substantially blocks much of the sound (as well as moisture or particulate) that enters the port 32 from reaching acceleration transducer assembly 42 and the rest of the chamber 24.

The clamp assembly 46 includes a first spacer ring 84, to hold the microphone diaphragm 62 against the housing 22, and a second spacer ring 86, to hold the acceleration diaphragm 74 in place. The acceleration diaphragm 74 is held between the first and second spacer rings 84, 86. The second spacer ring 86 is held in position by stakes 88 driven into the housing 22.

The first and second rings 84, 86 tightly hold the outer rings 70, 78 of the microphone and acceleration diaphragms 62, 74 in position. Nonetheless, because of the grooves 66, 76 cut into both diaphragms 62, 74, the inner flexing circles 68, 80 of the diaphragms 62, 74 are free to flex. The grooves 66, 76 effectively allow the diaphragms 62, 74 to hinge about the grooves 66, 76.

Accordingly, in operation, acoustic signals enter through the port 32 and cause the microphone transducer assembly 40 to provide an electrical signal on the microphone wire 54 and microphone terminal 56. Vibrations of the microphone 20, however, also cause the microphone transducer assembly 40 to provide undesired vibration signals to the microphone wire 54.

The microphone transducer assembly 40 tends to block acoustic signals from the acceleration transducer assembly 42. In the preferred embodiment, an acoustic signal alone may cause, for example, the microphone transducer assembly 40 to produce an electrical signal that is 20 or more times greater than the electrical signal produced by the acceleration transducer assembly 42 in response to the same acoustic signal entering the port 32. However, the vibration of the microphone 20 has substantially the same effect on the microphone transducer assembly 40 as on the acceleration transducer assembly 42. Accordingly, the signal applied to the acceleration wire 58 by the acceleration transducer assembly 42 represents, for the most part, only the effects of the vibration of the microphone 20.

Figure 6:
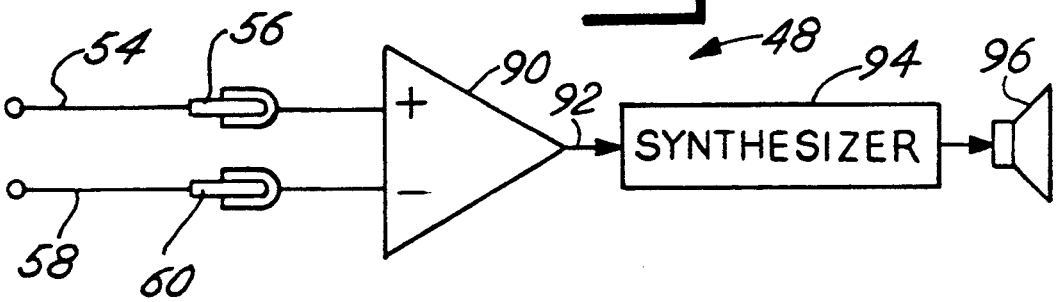
FIG. 6 is a schematic diagram of the signal processor used with the invention shown in FIG. 1.

As shown in FIG. 6, the terminal plugs 56, 60 may be interconnected to, for example, a differential amplifier 90. In such an amplifier 90, the signal from the acceleration transducer assembly 42 is subtracted from the signal supplied by the microphone transducer assembly 40, resulting in a signal along an output lead 92 which substantially only represents the acoustic signal (rather than the both the acoustic signal and the vibration).

The signal along the output lead 92 may, for example, be received by a synthesizer 94 that responsively provides a cancellation sound to be produced by a speaker 96. Alternatively, the signal may be used in other environments where the microphone 20 is subjected to extensive vibration and it is desirable to obtain a signal that represents only the acoustic signal rather than a signal which represents both sound and the results of vibrating the microphone 20.

Figure 7:
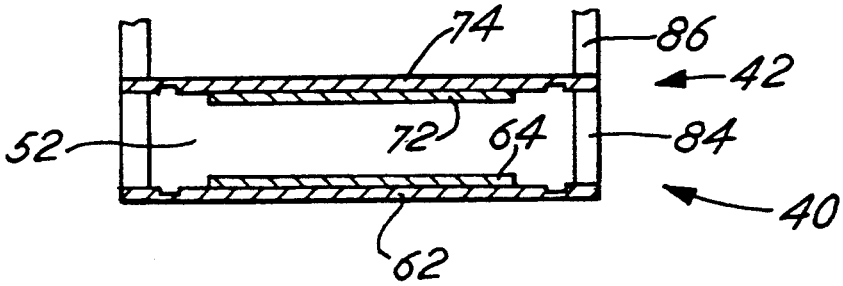
FIG. 7 is a partial, side, cross-sectional view of an alternative configuration of transducer assemblies for the invention shown in FIG. 1.
Figure 8:
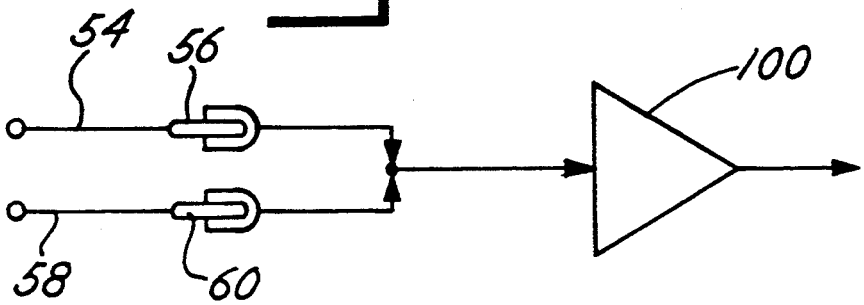
FIG. 8 is a schematic diagram of the signal processor used with the invention shown in FIG. 7.

In an alternative embodiment, represented in FIGS. 7–8, the ceramic transducer 72 and steel diaphragm 74 of the acceleration transducer assembly 42 may be reversed, such that both ceramic transducers 64, 72 are within the buffer space 52. In this way, when the microphone transducer assembly 40 supplies a positive signal as a result of vibration, the acceleration transducer assembly 42 will supply a negative signal of approximately the same magnitude.

Thus, the acceleration and microphone signals may simply be combined at a node 98 (or with an amplifier) to arrive at a signal substantially representing only the acoustic signal rather than both acoustic signal and the results of spurious vibration on the microphone 20. The signal at the node 98 may then be modified by an amplifier 100 for use in a synthesizer or other equipment.

Referring to FIGS. 9–12, a second preferred embodiment is shown as a microphone assembly 110. The operation of the assembly 110 may be understood through a discussion of other microphone assemblies 112, 114 shown in FIGS. 9 and 10.

Figure 9:
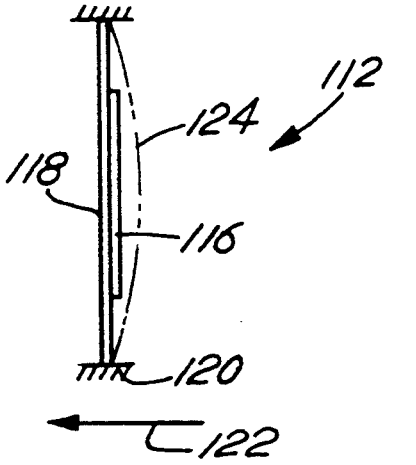
Fig. 9 (PRIOR ART)
FIG. 9 is a side view of a prior art microphone with a side support.

The prior art assembly 112 shown in FIG. 9 includes a ceramic transducer 116 bonded to a stainless steel diaphragm 118. The diaphragm 118 is held by a fixed edge support 120. If the microphone assembly 112 is accelerated to the left, according to the acceleration arrow 122, the center of the diaphragm 118 and ceramic transducer 116 are deflected to the "right" as shown by the dotted line 24. (The deflection is exaggerated by the dotted line for purposes of illustration).

Figure 10:
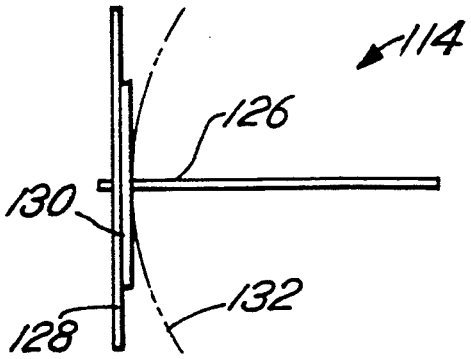
FIG. 10 is a side view of a microphone with a central support.

Alternatively, as shown in FIG. 10, a microphone assembly 114 may be mounted on a fixed, center support 126. Thus, for the same acceleration discussed with respect to FIG. 9, the deflection of the assembly 114 would have an opposite curvature (and the electrical signal produced would have an opposite value, or "polarity"). The periphery of the diaphragm 128 and ceramic transducer 130 would deflect to the "right," as shown by the dotted line 132.

Figure 11:
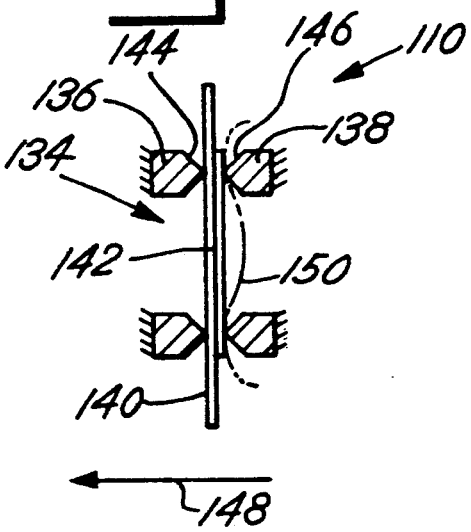
FIG. 11 is a side view of an alternative construction of the present invention.
Figure 12:
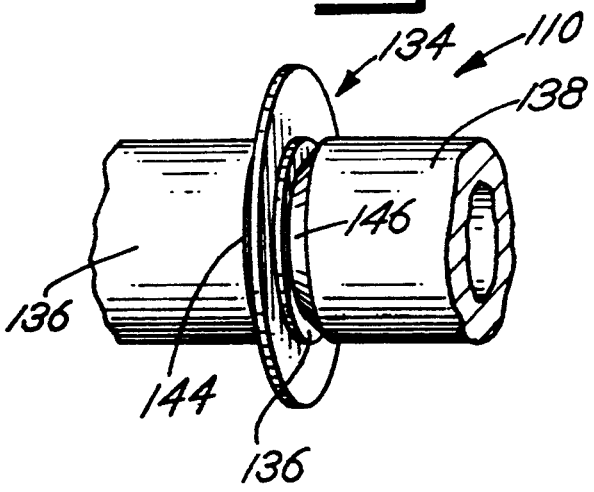
FIG. 12 is an isometric view of the invention shown in FIG. 11.

A preferred embodiment of the present invention is shown in FIGS. 11–12 as the microphone assembly 110. The microphone assembly 110 includes a transducer assembly 134 and first and second knife-edged mounting cylinders 136, 138. The assembly 110 may also include a spring or elastomeric mounting mechanism (not shown) to urge the cylinders 136, 138 toward each other.

The transducer assembly 134 includes a metal diaphragm 140 and ceramic transducer 142 bonded to the metal diaphragm 140. The diaphragm 140 is made of stainless steel and is approximately 0.006 inch thick and 0.8 inch in diameter. The ceramic transducer 142 is approximately 0.6 inch in diameter, with a silver electrode coveting over its surface.

Each of the mounting cylinders 136, 138 includes a knife-edge 144, 146 pressing against the transducer assembly 134. When the assembly 110 is accelerated toward the left, in the direction of the arrow 148, the transducer assembly 134 may deflect, as shown by the dotted line 150. When the assembly 134 is accelerated to the left, both the center of the transducer assembly 134, on one side of the knife edges 144, 146, and periphery of the transducer assembly 134, on the other side of the knife edges 144, 146, are effectively deflected to the "right." However, two zones of opposite curvature are formed in which the voltages are opposite and the resultant voltage will be reduced. By properly selecting the support diameter, a substantial null in the vibration response is produced. Since acoustic excitation is only applied to the center of the assembly 134, the "null"action does not occur, and substantial output is produced.

Consequently, the acceleration results in only a small electrical signal being responsively produced by the transducer 142. A relatively large electrical signal is produced by the transducer 142 when subjected to an acoustic signal, however.

In the preferred embodiment shown, the transducer assembly 134 is held by the substantially continuous knife edges 144, 146. In another embodiment, the mounting cylinders 136, 138 may be replaced, for example, with positioning assemblies that each have only three contact points with the transducer assembly 134, rather than a continuous edge.

Two preferred embodiments for the present invention have been described herein. It is to be understood, of course, that changes and modifications may be made in the embodiments without departing from the true scope and spirit of the present invention, as defined by the appended claims.

I claim:

1. A microphone for receiving an acoustic signal and responsively providing an electrical signal to an output lead, said microphone being subjected to vibration, comprising, in combination:

a housing having a chamber therein and defining a port into said chamber for receiving said acoustic signal form the exterior of the housing;

a microphone transducer positioned within said chamber for receiving said acoustic signal and sensing said vibration and responsively providing an electrical microphone signal to said output lead;

an acceleration transducer positioned within said chamber for sensing said vibration and responsively providing an electrical acceleration signal to said output lead said microphone transducer being between said acceleration transducer and said port; and a vent allowing communication between the two sides of the acceleration transducer, reducing the acoustic sensitivity of the acceleration transducer, whereby said microphone transducer provides a signal substantially in response to acoustic signals and vibration and said acceleration transducer provides a signal substantially in response to vibration.

2. A microphone as claimed in claim 1 wherein said microphone transducer extends across said chamber, substantially blocking the acoustic signal entering said port from said acceleration transducer.

3. A microphone as claimed in claim 2 wherein said microphone transducer and said acceleration transducer are substantially the same physical construction.

4. A microphone as claimed in claim 2 wherein said microphone transducer comprises a first metallic diaphragm bonded to a first ceramic transducer.

5. A microphone as claimed in claim 4 wherein said acceleration transducer comprises a second metallic diaphragm bonded to a second ceramic transducer.

6. A microphone as claimed in claim 5 wherein:

said microphone and acceleration transducers define a buffer space between them;

said output lead includes first and second inputs;

said first ceramic transducer is bonded to said first diaphragm within said buffer space and is interconnected to said first input; and said second ceramic transducer is bonded to said second diaphragm within said buffer space and is interconnected to said second input.

7. A microphone as claimed in claim 6 wherein:

said microphone transducer provides a microphone signal in response to movement of said housing in a particular direction and said acceleration transducer provides an inverse acceleration signal in response to said movement of said housing in said particular direction; and said microphone and acceleration signals are combined to provide a combined signal representing said acoustic signal.

8. A microphone as claimed in claim 5 wherein said housing is comprised of metal and said port includes threads for fixedly attaching said microphone to an exhaust system of an automotive vehicle.

9. A microphone as claimed in claim 5 wherein said output lead is interconnected to a synthesizer for receiving said signals from said microphone and responsively providing a noise cancelling signal.

10. A microphone as claimed in claim 5 wherein at least one of said diaphragms is fixedly attached to said housing.

11. A microphone as claimed in claim 10 wherein at least one of said diaphragms includes a groove encircling said ceramic transducer, said groove substantially dividing said diaphragm into fixed and flexing portions, said diaphragm flexing along said groove within said housing.

12. A microphone as claimed in claim 11 wherein said diaphragm defines a thickness and said groove defines a depth that is substantially more than one-quarter and less than three-quarters of said thickness of said diaphragm.

13. A microphone as claimed in claim 11 wherein each of said first and second diaphragms are fixedly attached to said housing, each of said diaphragms includes a groove encircling a ceramic transducer, and each of said grooves substantially divides one of said diaphragms into fixed and flexing portions.

14. A microphone as claimed in claim 5 wherein said microphone includes a continuous buffer space defined by said microphone and acceleration transducers inside said chamber, whereby said acceleration transducer is less responsive to acoustic signals and said acceleration transducer and said housing define a substantially closed air-chamber within said housing.

15. A microphone as claimed in claim 14 wherein said air-chamber includes a supplemental vent, whereby said supplemental vent passes through said housing and allows the air within said air-chamber to vent outside of said housing.

16. A microphone as claimed in claim 15 wherein said housing defines a substantially closed shell about said port for blocking moisture from said chamber.

17. A microphone as claimed in claim 14 wherein:

said acceleration transducer and said housing define an air-chamber within said housing;

said output lead includes first and second inputs;

said first ceramic transducer is bonded to said first diaphragm within said buffer space and is interconnected to said first input; and said second ceramic transducer is bonded to said second diaphragm within said air-chamber and is interconnected to said second input.

18. A microphone as claimed in claim 17 further comprising a differential amplifier interconnected to said first and second inputs, whereby said signal from said acceleration transducer is subtracted from said signal from said microphone transducer and said differential amplifier produces a differential signal substantially representing said acoustic signal.

19. A method for generating an electrical signal representative of an acoustic signal in a vibrating environment comprising:

sensing the acoustic signal from the vibrating environment with a microphone assembly;

sensing a vibrational signal from the vibrating environment with the microphone assembly;

subtracting said acoustic signal from said vibrational signal in said microphone assembly; and generating an electrical signal representative of only the acoustic signal said microphone assembly comprising, in combination:

a transducer assembly having at least two sides;

a first mounting assembly having at least three contact points positioned against one side of said transducer assembly; and a second mounting assembly having at least three contact points positioned against another side of transducer assembly, wherein at least one of said first mounting assembly or said second mounting assembly is a cylinder and said contact points of said first and second mounting assemblies are directly opposing each other and holding said transducer assembly in position, whereby said transducer assembly flexes about said contact points when exposed to said acoustic and vibrational signals substantially cancelling the effect of the vibrational signals.

20. A method for generating an electrical signal representative of an acoustic signal in a vibrating environment comprising:

sensing the acoustic signal from the vibrating environment with a microphone assembly;

sensing a vibrational signal from the vibrating environment with the microphone assembly;

subtracting said acoustic signal from said vibrational signal in said microphone assembly; and generating an electrical signal representative of only the acoustic signal said microphone assembly comprising, in combination:

a transducer assembly having at least two sides;

a first mounting cylinder having a knife edge positioned against one side of said transducer assembly; and a second mounting cylinder having a knife edge positioned against another side of said transducer assembly, said knife edges of first and second mounting cylinders holding said transducer assembly in position, whereby said transducer assembly flexes about said knife edges when exposed to said acoustic and vibrational signals substantially cancelling the effect of the vibrational signals.

21. The method of claim 20 wherein:

said transducer assembly comprises a diaphragm bonded to a transducer; and said knife edge of said first cylinder is adjacent said transducer and said knife edge of said second cylinder is adjacent said diaphragm.

22. A microphone for receiving an acoustic signal and responsively providing an electrical signal to an output lead, said microphone being subjected to vibration, comprising, in combination:

a housing having a chamber therein and defining a port into said chamber for receiving said acoustic signal from the exterior of the housing;

a microphone transducer positioned within said chamber for receiving said acoustic signal and sensing said vibration and responsively providing an electrical microphone signal to said output lead;

an acceleration transducer having reduced acoustic sensitivity positioned within said chamber for sensing said vibration and responsively providing an electrical acceleration signal to said output lead said microphone transducer being between said acceleration transducer and said port and said acceleration transducer being of substantially the same physical construction as said microphone transducer whereby said microphone transducer provides a signal substantially in response to acoustic signals and vibration and said acceleration transducer provides a signal substantially in response to vibration.

* * * * *